United States Patent [19]

Young

[11] Patent Number: 5,065,666

[45] Date of Patent: Nov. 19, 1991

[54] SEQUENCE VALVE

[75] Inventor: Terry G. Young, Spring, Tex.

[73] Assignee: Baker Hughes Incorporated, Houston, Tex.

[21] Appl. No.: 516,076

[22] Filed: Apr. 27, 1990

[51] Int. Cl.[5] ..... F15B 13/07

[52] U.S. Cl. ..... 91/518; 137/102; 137/596.18; 137/625.66; 166/72

[58] Field of Search ..... 137/102, 596.18, 625.66; 166/72; 91/518

[56] References Cited

U.S. PATENT DOCUMENTS

| | | | |
|---|---|---|---|
| 2,993,511 | 7/1961 | Johnson | 137/625.64 |
| 3,570,371 | 3/1971 | Herd | 91/518 |
| 3,618,984 | 11/1971 | Cook et al. | 91/518 X |
| 3,683,966 | 8/1972 | Payne | 137/625.48 |
| 3,856,037 | 12/1974 | Garrett et al. | 166/72 X |
| 3,952,763 | 4/1976 | Baugh | 137/106 X |
| 4,004,610 | 1/1977 | Theriot | 137/107 X |
| 4,187,883 | 2/1980 | Webster | 137/625.68 |
| 4,355,658 | 10/1982 | Snyder | 137/625.66 X |

*Primary Examiner*—Gerald A. Michalsky
*Attorney, Agent, or Firm*—Rosenblatt & Associates

[57] ABSTRACT

A sequence valve for directing fluid pressure is provided, having a fluid pressure inlet, a first actuator outlet with associated vent port, and a second actuator outlet with an associated vent port. A spool is movably mounted within the body for selective direction of fluid pressure applied to the inlet to either of the actuator outlets or selectively to bleed pressure applied to either of the actuator outlets through respective vent portions in a predetermined sequence.

24 Claims, 5 Drawing Sheets

SEQUENCE VALVE

FIELD OF THE INVENTION

The field of this invention relates to valves, particularly those useful in pneumatic or hydraulic circuits to control the sequence of direction of pneumatic or hydraulic pressure to various valve actuators for surface and subsurface valves used in oil and gas wells.

BACKGROUND OF THE INVENTION

Typically, in an oil and gas well, surface safety valves (SSV) and subsurface safety valves (SCSSV) are used in the piping configuration. It is desirable when putting the well in service or for gaining access to the well to primarily open the SCSSV before opening the SSV. Similarly, if the well is in production and emergency situations arise, it is preferable to first close the SSV and then close the SCSSV. Prior systems have provided complex hydraulic circuits to regulate the sequencing of the opening and closing of the SSV and SCSSV. Prior art systems were complex to design, had numerous components, and took a significant amount of space to assemble and install. The multiplicity of components further added to the expense of assembly of these control systems and increased the possibility that maintenance would have to be performed.

It is, thus, an object of the invention to simplify prior hydraulic circuits by combining and eliminating certain components in order to achieve in a unitary valve the ability properly sequence the SSV and SCSSV in a prescribed manner. It is also an object of this invention to provide for orderly operation of the SSV and SCSSV in the event of failure of primary hydraulic/-pneumatic pressure supply. It is also an object of this invention to provide a sequence valve which allows for quick emergency shutdown of the SSV in the event of an emergency.

SUMMARY OF THE INVENTION

A sequence valve for directing fluid pressure is provided, having a fluid pressure inlet, a first actuator outlet with associated vent port, and a second actuator outlet with an associated vent port. A spool is movably mounted within the body for selective direction of fluid pressure applied to the inlet to either of the actuator outlets or selectively to bleed pressure applied to either of the actuator outlets through respective vent ports in a predetermined sequence.

DETAILED DESCRIPTION OF THE PREFERRED EMBODIMENT

Figure 1:
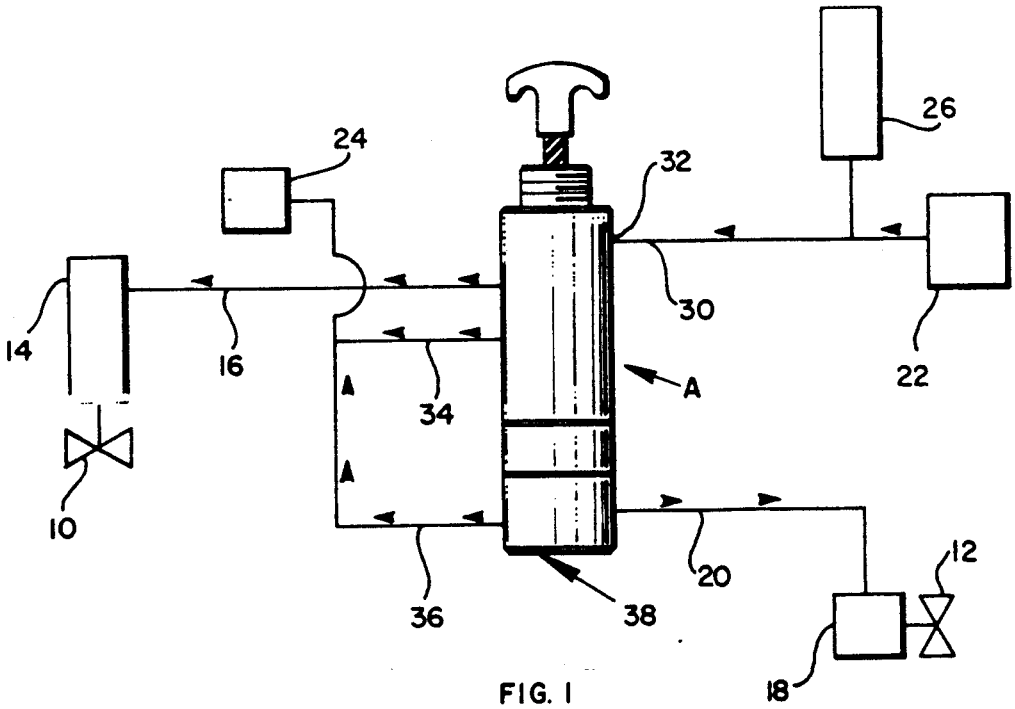
FIG. 1 is a schematic of the use of the preferred embodiment of the invention, illustrating the fluid pressure source, the sump, and two valve actuators connected to the sequence valve of the present invention.

The apparatus A of the present invention is shown in FIG. 1. While the apparatus A is shown in an oilfield application, it can readily be used to sequence any valves in applications other than oil and gas wells.

In an oil and gas application, an SSV 10 is employed adjacent the wellhead so that the well could be shut-in in case of emergency as close to the wellhead as possible. An SCSSV 12 is also employed in many well applications. SSV 10 has an actuator 14 which generally is hydraulically powered. For the purposes of this application, it will be assumed that actuator 14 is of the style that hydraulic pressure entering it through line 16 opens SSV 10. Similarly, SCSSV 12 has an actuator 18 which operates in a similar manner to actuator 14 when fluid pressure is applied through line 20. The source of hydraulic pressure is a pump skid 22, which is schematically illustrated in FIG. 1. For simplicity, none of the controls associated with pump 22 are illustrated. The sump 24 is also shown in FIG. 1. Although sump 24 is shown as separate from pump 22, they can be and are frequently combined in one cohesive skid unit. FIG. 1 also illustrates an accumulator 26, which is a common feature in hydraulic systems and is generally mounted close to the hydraulic pump 22.

Figure 2:
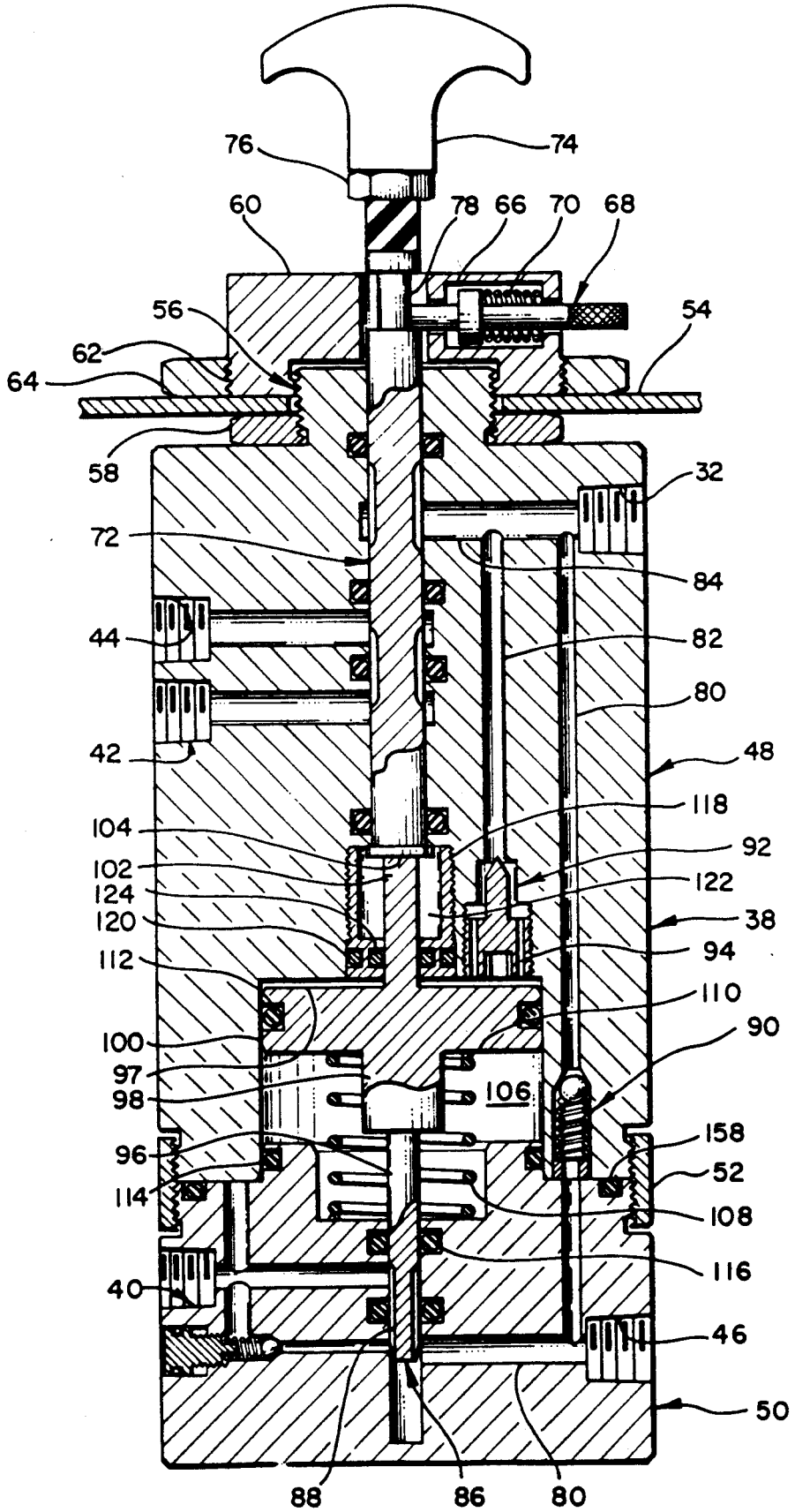
FIG. 2 is a sectional elevational view of the sequence valve shown in FIG. 1 upon initial application of pressure at the inlet port.

Line 30 extends from the pump 22 to the inlet 32 of the apparatus A. In the preferred embodiment, there are two vent lines 34 and 36, which extend from the valve body 38. Vent lines 34 and 36 can be joined together, as shown in FIG. 1, and routed to sump 24. Alternatively, separate lines can be run from body 38 to sump 24. As shown in FIG. 2, vent line 36 extends from vent port 40, and vent line 34 extends from vent port 42.

Line 16 extends from actuator outlet 44 to actuator 14 on SSV 10. Line 20 extends from actuator outlet 46 to actuator 18 on SCSSV 12. As seen in FIG. 2, all ports 40, 42, 44 and 46 have threaded connections to facilitate joining of pipe to body 38. Body 38 has several major components. Primarily, body 38 is divided into two mating sections, upper section 48 and lower section 50. Sections 48 and 50 are joined together by coupling 52. Body 38 is adaptable for mounting to a panel 54. Upper section 48 has an extension segment 56, which is threaded to accept nuts 58 and 60. Cap nut 60 has an outer thread 62 which facilitates mounting of lock nut 64. The body 38 is held to panel 54 by first securing nut 58 over extension segment 56. Thereafter, extension segment 56 is put through panel 54, whereupon nut 60 is secured to extension segment 56 and nut 64 is secured to thread 62, thereby retaining body 38 to panel 54.

Nut 60 has an internal recess cavity 66 in which shaft detent 68 is housed. Spring 70 biases shaft detent 68 toward the uppermost spool 72. Spool 72 has an elongated generally cylindrical shape and, in the preferred embodiment, extends through extension segment 56. The uppermost extremity of spool 72 terminates in a knob 74. Knob 74 is secured with lock nut 76 to spool 72. Spool 72 has a reduced diameter section 78. Shaft detent 68 is biased by spring 70 to enter into reduced diameter section 78 when section 78 is brought into alignment with the shaft detent 68. Section 78 is brought into alignment with shaft detent 68 when knob 74 is pulled out, as shown in FIG. 2. As a result, detent 68 keeps spool 72 from being accidentally pushed in at an inopportune time.

Connected to inlet 32 are a plurality of inlet passages 80, 82 and 84. In the preferred embodiment, all three of these passages overlap adjacent inlet 32. Thereafter, these passages diverge, with passage 80 extending downwardly and terminating in two locations, at actuator outlet 46 and at lowermost spool 86. Lowermost spool 86 has a plurality of splines 88 at its lower end.

Referring more particularly to inlet passage 80, as it traverses upper section 48, a check valve 90 is disposed therein and set up to allow flow in one direction from inlet 32 to outlet 46 and to eliminate flow in the reverse direction from outlet 46 toward inlet 32. The form of check valve 90 shown in FIG. 2 is the spring-loaded ball-type; however, other types of check valves can be used without departing from the spirit of the invention.

Inlet passage 82 extends from inlet 32 through a flow restriction 92. Flow restriction 92 is an insert which is threaded into passage 82, which contains a plurality of orifices 94. Thereafter, passage 82 terminates at the lowermost spool 86, more particularly adjacent surface 97. Lower spool 86 is formed having a lower cylindrical portion 96 connected to transition portion 98, which is connected to an annularly shaped section 100. Lower spool 86 terminates in a neck portion 102. Neck portion 102 selectively contacts upper spool 72 at point 104. It should be noted that spool 86 is not always in contact with spool 72, as will be explained in more detail below.

Figure 5:
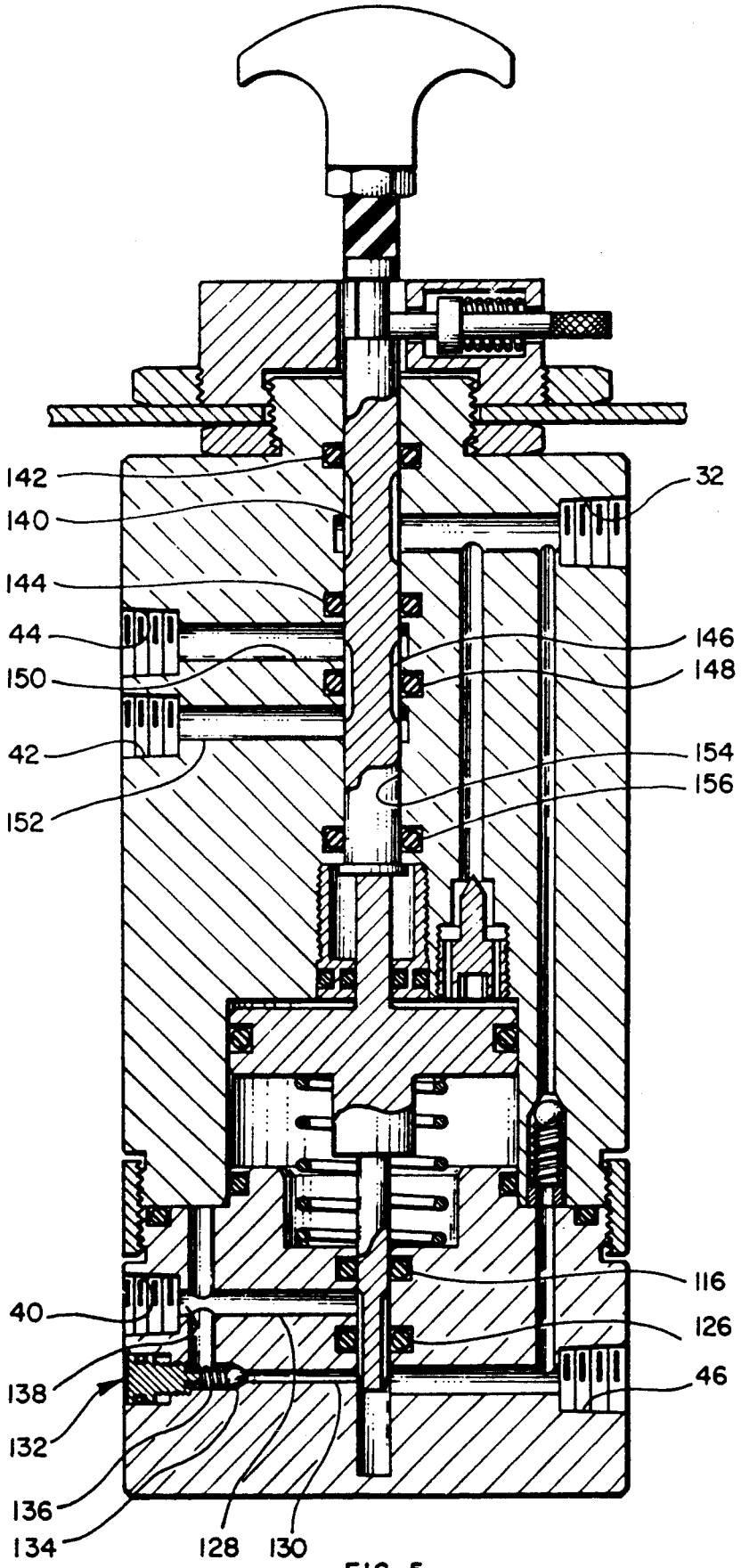
FIG. 5 shows the sequence valve with the uppermost spool pulled out during application of pressure to the inlet.

As shown in FIGS. 2 and 5, upper section 48 and lower section 50 include a cavity 106. Disposed in cavity 106 is spring 108, which biases surface 110 upwardly, thereby driving lower spool 86 toward upper spool 72. It should be noted that annular-shaped section 100 has a lower surface 110 and an upper surface 97. In between, seal 112 is one of the seals that isolates cavity 106 but allows lower spool 86 to move within cavity 106. Additionally, seal 114 seals cavity 106 at the juncture between lower section 50 and upper section 48. Finally, cavity 106 is sealed against lower cylindrical portion 96 by virtue of seal 116.

Going back now to inlet passage 82 and flow restriction 92, it can readily be seen that when hydraulic pressure is applied at inlet 32, its rate of flow into fluid communication with surface 97 will be controlled by flow restriction 92. Therefore, introduction of hydraulic pressure into inlet 32 exerts a downward force on surface 97 in opposition to the biasing force of spring 108 acting on surface 110. At the upper end of cavity 106 is an insert 118 which is threadedly engaged to upper section 48 and sealed therewith by virtue of seal 120. Insert 118 has an internal cavity 122 through which neck portion 102 traverses. Seal 124 seals between neck portion 102 and insert 118. Seal 124 also seals cavity 106 from internal cavity 122.

Seal 126 seals between lower section 50 and lower spool 86. Passage 128 extends between lower spool 86 and outlet 40. Passage 128 terminates at lower spool 86 between seals 116 and 126. On the opposite side of seal 126 from passage 128 is relief passage 130. Relief passage 130 extends from lower spool 86 to a relief valve 132 mounted internally in lower section 50. Relief valve 132 shown in the preferred embodiment is of the spring-loaded ball-type which keeps ball 134 seated such that passage 130 is capped off unless the pressure therein exceeds a preset value. At that point, ball 134 displaces spring 136, opening up passage 130 to passage 138, which ultimately communicates with outlet 40. Accordingly, relief valve 130 prevents overpressure at outlet 46 as a result of hydraulic pressure applied at inlet 32.

Figure 4:
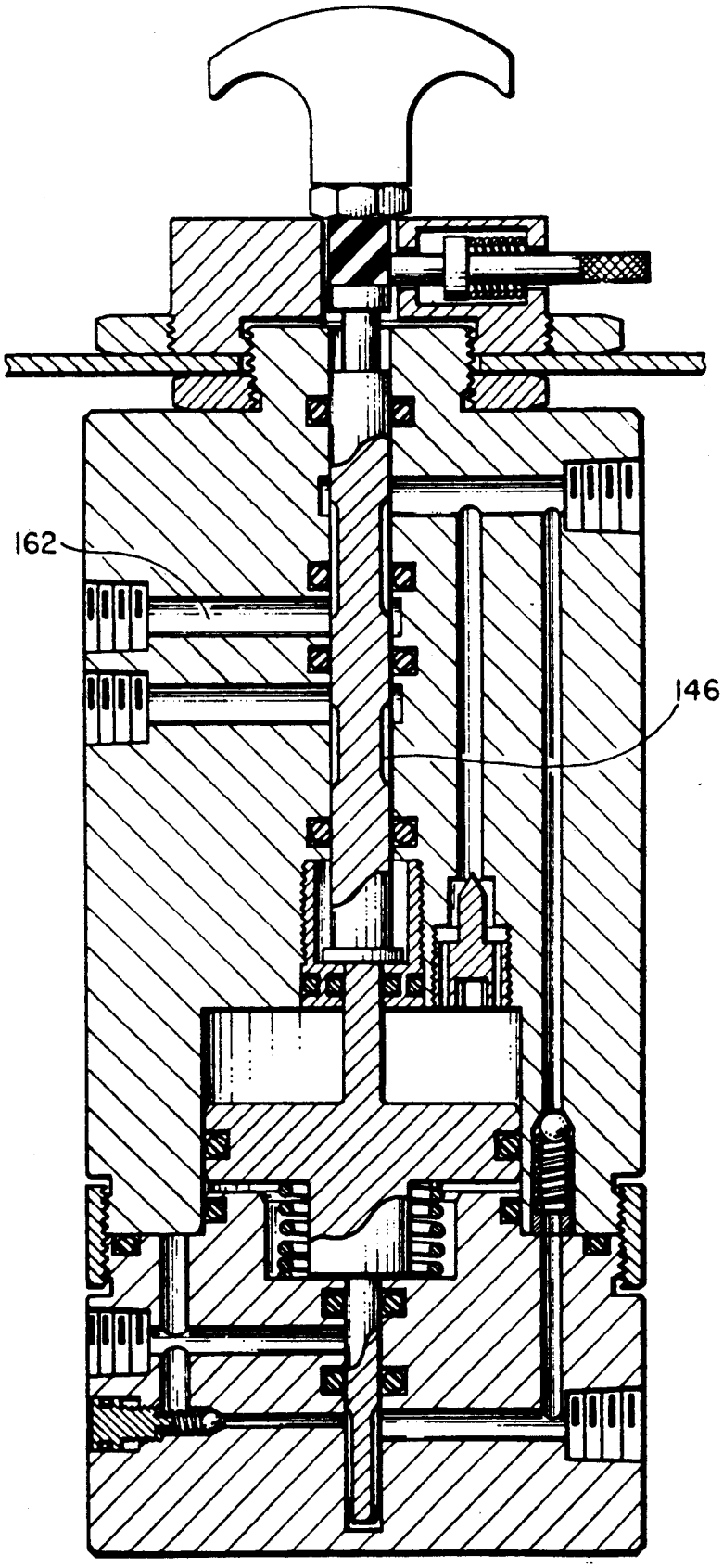
FIG. 4 shows the sequence valve with the uppermost spool in a second position with respect to FIG. 3.

The full range of motion of lower spool 86 is illustrated by looking at FIGS. 2 and 4. FIG. 2 illustrates a first position for lower spool 86, and FIG. 4 illustrates a second position for lower spool 86. It should be noted by looking at FIGS. 2 and 4 that in both positions, splines 88, or parts thereof, are in line with inlet passage 80 and relief passage 130. That is, regardless of the position of lower spool 86, there is always flow communication between inlet passage 80 and relief passage 130 so that there is continual overpressure protection for the SCSSV actuator 18 (see FIG. 1), which is connected to outlet 46.

Figure 3:
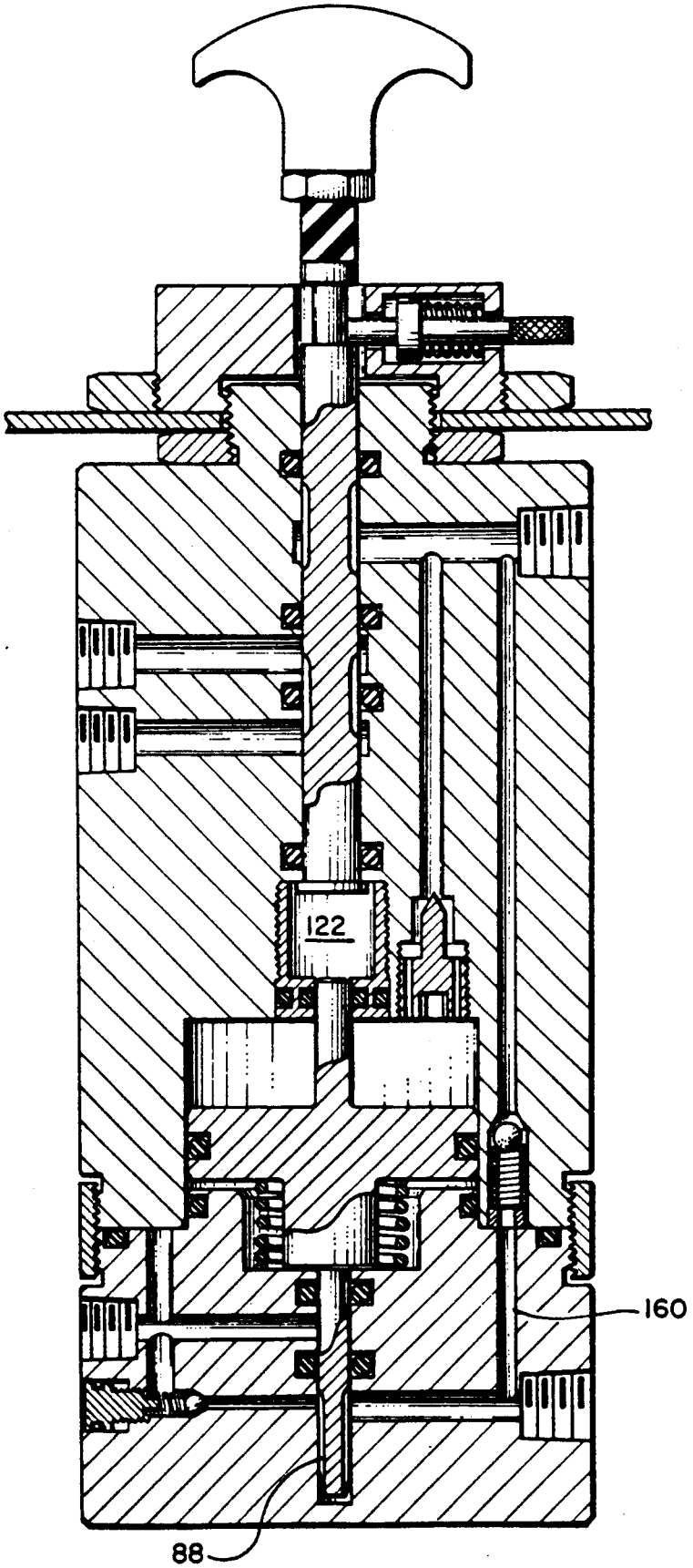
FIG. 3 is similar to FIG. 2, showing the sequence valve with pressure applied to the inlet and the lowermost spool in a second position.

As shown in FIG. 3, in the second position of lowermost spool 86, splines 88 are not in contact with seal 126, whereas in FIG. 2, splines 88 traverse seal 126. In the first position, illustrated in FIG. 2, the juxtaposition of splines 88 next to seal 126 allows fluid communication from inlet passage 80 to outlet passage 128.

Those skilled in the art can readily appreciate that without any hydraulic pressure applied at inlet 32, spring 108 biases lowermost spool 86 into its first position shown in FIG. 2. With lowermost spool 86 in its first position, shown in FIG. 2, there is contact at point 104 between lowermost spool 86 and upper spool 72. It should be noted that the preferred embodiment functions with a lower spool 86 and an upper spool 72. These can be broken down into a greater number of spools by using intermediate spools. However, in the preferred embodiment, lower spool 86 and upper spool 72 are sufficient.

Upon application of pressure at inlet 32 and the apparatus A in the position shown in FIG. 2, the pressure immediately flows into passages 80, 82 and 84. Thereafter, check valve 90 is placed in a position permitting flow from inlet 32 to outlet 46. However, in the first position shown in FIG. 2, vent passage 128 is also aligned to be in flow communication with inlet passage 80 since splines 88 straddle seal 126. Gradually, as hydraulic pressure in passage 82 passes through orifices 94, a downward force is exerted on surface 97, overcoming the upward force of spring 108 and moving lower spool 86 toward the position shown in FIGS. 3 and 4. As lower spool 86 moves downwardly, splines 88 move completely outside the space between seals 116 and 126. When that happens, inlet passage 80 is isolated from outlet passage 128. Since at the same time hydraulic pressure continues to be exerted at inlet 32, pressure at outlet 46 can begin to build up as soon as lower spool 86 has moved downward sufficiently to put splines 88 outside of the span between seals 116 and 126. Regardless of the position of lower spool 86, splines 88 always allow fluid communication between inlet passage 80 and relief passage 130 to prevent overpressure at outlet 46.

One of the important features of the apparatus A of the present invention is to ensure that upon system start-up, the SCSSV 12 is opened first before the SSV 10. With the configuration as shown in FIG. 2, in the absence of any hydraulic pressure at inlet 32, upper spool 72 is in its fully extended position. Upper spool 72 is also retained by detent 68 in its first or outwardly extended position. FIG. 2 illustrates that when the upper spool 72 is in the first position, splines 140 are disposed between seals 142 and 144. At the same time, splines 146 straddle seal 148, allowing fluid communication between outlet 44 and vent port 42. Outlet passage 150 extends between upper spool 72 and outlet port 44. Vent passage 152 extends from vent port 42 to upper spool 72. Upper spool 72 is disposed in bore 154 located in upper section 48. Vent passage 152 is disposed in contact with bore 154 at a point between seal 148 and seal 156. Outlet passage 150 is in flow communication with bore 154 at a point between seals 144 and 148.

Figure 6:
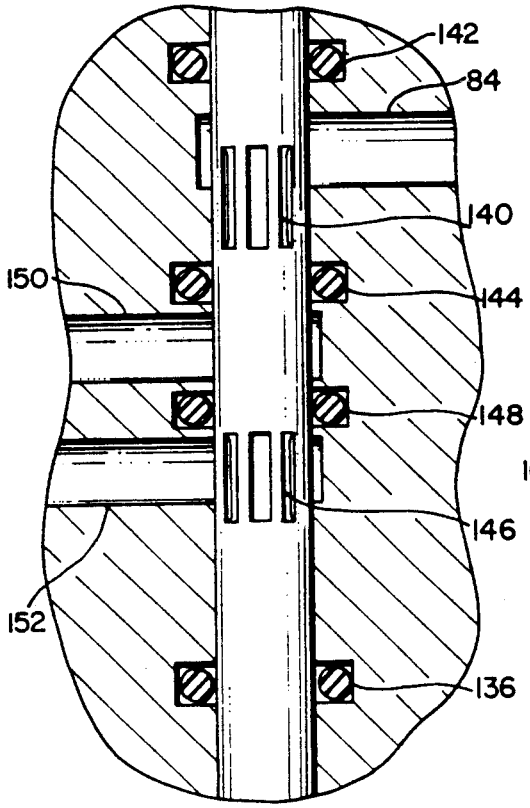
FIG. 6 is a partial sectional elevational view of the uppermost spool, showing it in the "closed center" position.

Referring to FIGS. 3, 5 and 6, it can be seen that upper spool 72, as it passes from the first position (FIG. 5) to a second position (FIG. 4), passes through a closed center position (FIG. 6), wherein spline 140 is disposed between seals 142 and 144 and spline 146 is disposed between seals 148 and 156. In the closed center position shown in FIG. 6, inlet passage 84 is isolated from outlet passage 150, and outlet passage 150 is isolated from vent passage 152.

All of the components of the apparatus having been described, its sequence of operation will be described hereinbelow. Initially, the apparatus A is in the position shown in FIG. 2. Detent 68 is holding upper spool 72 in its first position. Spring 108 is biasing lower spool 86 into contact with upper spool 72 at point 104. There is no pressure applied at inlet 32 at this time. As the pump 22 (FIG. 1) is actuated by applying hydraulic pressure to inlet 32, inlet passage 84 is sealed off by the placement of spline 140 between seals 142 and 144. Hydraulic pressure at inlet 32 traverses inlet passage 80 and opens check valve 90, resulting in hydraulic fluid flow into outlet port 46 and into splines 88 through to relief passage 130 and passage 128 to vent port 40. As a result, with passage 128 aligned in flow communication to inlet passage 80, pressure cannot build up at outlet port 46 initially. However, hydraulic pressure entering at inlet 32 travels down passage 82 through orifices 94 and begins to exert downward pressure on surface 97. Lower spool 86 moves from its first position shown in FIG. 2 to its second position shown in FIG. 3. As spool 86 moves downwardly from position one to position two, it moves out of contact with upper spool 72. This is shown in FIG. 3 within cavity 122. As previously stated, when lower spool 86 moves into its second position shown in FIG. 3, fluid communication between inlet passage 80 and vent passage 128 is interrupted as splines move into a position where they don't straddle seal 126. As soon as this occurs, pressure can build up at outlet port 46, as shown in FIG. 3 by arrow 160. As soon as sufficient pressure is developed in outlet port 46, actuator 18 on SCSSV 12 operates to open SCSSV 12. The movement of lower spool 86 from position one to two (FIG. 2 v. FIG. 3) results in the volume reduction of cavity 106 and compression of spring 108. Since cavity 106 is filled with a compressible fluid, typically air, when lower spool 86 is in the second position (FIG. 3), the fluid adjacent spring 108 is compressed and the pressure generated by such compression acts in tandem with spring 108 to exert a return force on surface 110, which tends to bias lower spool 86 upwardly. However, at this time, the hydraulic pressure applied at inlet 32 through passage 82 to surface 97 exceeds the forces exerted in the opposite direction on surface 110 by spring 108 and the compressed gas in cavity 106. Additionally, the inlet pressure coming through port 32 through inlet passage 80 also creates an upward force on lower spool 86 by acting at the bottom of lower cylindrical portion 96. It should be noted that in the preferred embodiment, the ratio of cross-sectional areas of lower cylindrical portion 96 and annular section 100 is approximately 1:100. The significance of this ratio will be further explained below.

Having gotten the apparatus A of the present invention into the configuration shown in FIG. 3 with hydraulic pressure applied to inlet 32, it is desirable, having fully opened the SCSSV 12, to then open the SSV 10. This is accomplished by manually retracting detent 68 and pushing down on knob 74, thus moving upper spool 72 from its first position to its second position. The second position is illustrated in FIG. 4. Pushing in knob 74 places spline 140 across seal 144 and moves spline 146 from a position straddling seal 148 to a second position where spline 146 is disposed between seals 148 and 156. As shown in FIG. 4 by arrow 162, pushing down on knob 74 with pressure applied to inlet 32 results in flow through passage 84 through splines 140 and into outlet 44. With outlet 44 isolated from vent port 42, pressure builds up at actuator 14 (see FIG. 1), resulting in opening of SSV 10 after the SCSSV 12 has already been opened.

There could arise situations with the apparatus A of the present invention, in the position illustrated in FIG. 4 with fluid pressure applied to inlet 32, that an emergency situation could occur at the surface requiring immediate shutdown of the SSV 10. The apparatus A of the present invention is adapted to accomplish this purpose. An upward pull on knob 74 puts the apparatus A in the position shown in FIG. 3. Pulling up on knob 74 isolates inlet passage 84 from bore 154 and vents the pressure at actuator 14 on SSV 10 back into the apparatus A by allowing flow into outlet port 44 through passage 150, through splines 146 to vent passage 152, and out through sump 24 via vent port 42. Thus, with the apparatus A in the configuration in FIG. 3, the SCSSV 12 stays in an open position and the SSV 10 closes at the surface to deal with the emergency.

Another situation that may occur is the loss of hydraulic pressure due to a malfunction of pump 22 or a line break. Typically, the loss of hydraulic pressure at inlet 32 will occur when the apparatus A is in the configuration shown in FIG. 4. That is, both upper spool 72 and lower spool 86 are in their second position. Initially, there will be a loss of pressure at inlet 32. As a result, check valve 90 will seat immediately, thus retaining the pre-existing pressure at outlet 46 while the pressure at inlet 32 drops toward zero. Eventually, the pressure at inlet 32 and more particularly on surface 97 is reduced to a critical pressure corresponding with a resultant force acting downwardly on surface 97 decreasing to below a critical level. At some point, depending upon the ratio of cross-sectional areas of surface 97 and the cross-sectional area of lower cylindrical portion 96, the downward force acting on surface 97 will be reduced to a level where the upward forces exerted on surface 110 by spring 108 and the compressed gas in chamber 106 exceed the downward forces exerted on surface 97. When this occurs, lower spool 86 is biased from its second position toward its first position. Since lower spool 86 was in contact with upper spool 72 at point 104 before the loss of pressure at inlet 32 (see FIG. 4), both lower spool 86 and upper spool 72 are driven in tandem toward their respective first positions. During the course of this upward movement, the first thing that occurs is that spline 140 fully lands between seals 142 and 144. The closed center position is thus achieved. Upon continued upward movement of lower spool 86 and upper spool 72, spline 140 continues to remain in position between seals 142 and 144. The next thing that occurs is that spline 146 moves from a position between seals 148 and 156 to a position where it straddles seal 148. Thereafter, spline 88 moves from a position of being below seal 126 to a position straddling seal 126. The net effect of the timing of movement of splines 140, 146 and 88 is that inlet 32 is first isolated from outlet 44. It should be noted that even before this occurs, check valve 90 has isolated outlet 46 from inlet 32. Having isolated inlet 32 completely from outlets 44 and 46, the pressure in line 16 is relieved through outlet 42, closing the SSV 10. Only after this has occurred, the pressure remaining bottled up in line 20 as a result of the closing of check valve 90 is relieved to vent port 40, allowing the SCSSV 12 to close.

Those skilled in the art can appreciate that the apparatus A is fairly simple in construction and provides a compact package which ensures, upon start-up of operations, the desired sequence of opening the SCSSV 12 first before opening the SSV 10. Furthermore, the apparatus A provides for quick response to emergency situations by allowing the SCSSV 12 to remain open while the SSV 10 is closed at the surface simply by the push of knob 74.

Finally, the design also incorporates another safety feature in that upon loss of hydraulic pressure, the desired shut-down sequence of the SSV 10 first, followed by the SCSSV 12 second, is automatically accomplished. Another safety feature is that detent 68 prevents accidental opening of the SSV 10 at an inopportune time by a person or an object inadvertently striking knob 74 with hydraulic pressure applied at inlet 32 and upper spool 72 in the position shown in FIGS. 2, 3 or 5.

Those skilled in the art can appreciate that the apparatus of the present invention is also functional without spring 108.

It is also within the scope of the invention to employ more than just two spools within the body 48. However, the design as shown in the figures is the simplest to manufacture and works with the greatest ease.

Figure 7:
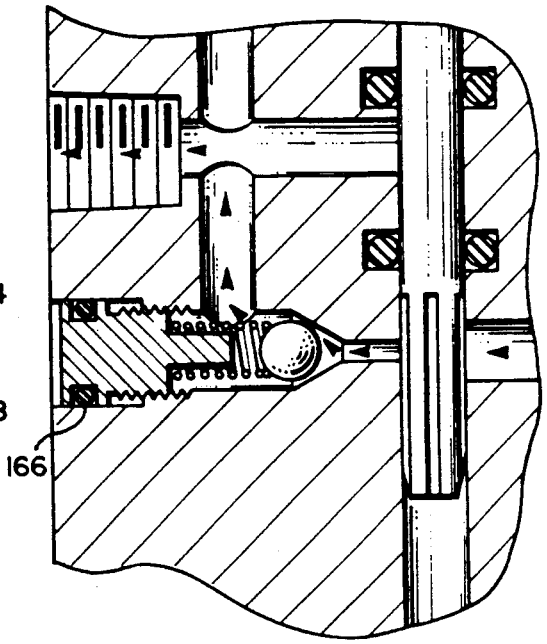
FIG. 7 is a partial sectional elevational view showing the relief valve built into the sequence valve.

As shown in FIG. 7, seal 166 prevents leakage around relief valve 132.

The foregoing disclosure and description of the invention are illustrative and explanatory thereof, and various changes in the size, shape and materials, as well as in the details of the illustrated construction, may be made without departing from the spirit of the invention.

I claim:

1. An apparatus for directing fluid pressure from a primary source to at least two actuators, comprising:

a body;

at least one inlet into said body for admitting primary source pressure;

at least one first actuator outlet in said body;

at least one second actuator outlet in said body;

spool means selectively movable in said body manually and by fluid pressure from the primary source for selective sequential alignment of the pressure at said inlet to said first and then second actuator outlets as said spool means moves in a first direction, and for selective sequential venting of the pressure at said first and second actuator outlets from said body and isolation of said inlet as said spool means moves in a second direction, opposite said first direction, upon loss of fluid pressure at said inlet;

said spool means selectively manually operable in said second direction to vent at least one of said outlets while isolating it from said inlet.

2. The apparatus of claim 1, wherein said spool means is constructed of an upper and a lower segment selectively movable in tandem and independently.

3. The apparatus of claim 1, wherein said body is formed having a plurality of inlet passages providing fluid communication from said inlet to said spool means.

4. The apparatus of claim 3, wherein said spool means has a first cross-sectional area having an upper and a lower surface, said upper surface of said first cross-sectional area being in flow communication with a first of said inlet passages.

5. The apparatus of claim 1, further comprising:

an actuator connected to said first actuator outlet; and an actuator connected to said second actuator outlet.

6. An apparatus for directing fluid pressure from a primary source to at least tow actuators, comprising:

a body;

at least one inlet in said body for admitting primary source pressure;

at least one first actuator outlet in said body;

at least one second actuator outlet in said body;

spool means selectively movable in said body manually and by fluid pressure from the primary source for selective sequential alignment of the pressure at said inlet to said first and then said second actuator outlets and for selective venting of the pressure at said first and second actuator outlets from said body;

flow restriction means in fluid communication within said inlet for regulating the rate of fluid pressure transfer from said inlet to said spool means.

7. The apparatus of claim 6, further comprising:

flow control means in fluid communication between said inlet and at lest one of said actuator outlets and automatically operable to permit or prohibit flow therebetween.

8. The apparatus of claim 6, further comprising:

an actuator connected to said first actuator outlet; and an actuator connected to said second actuator outlet.

9. An apparatus for directing fluid pressure from a primary source to at least one actuator, comprising:

a body;

at least one inlet for admitting primary source pressure;

at least one first actuator outlet;

at least one second actuator outlet;

spool means selectively movable in said body for selectively sequential alignment of the pressure at said inlet to said first and second actuator outlets and for selective venting of the pressure at said first and second actuator outlets from said body;

said body is formed having a plurality of inlet passages providing fluid communication from said inlet to said spool means;

said spool means has a first cross-sectional area having an upper and a lower surface, said upper surface of said first cross-sectional area being in flow communication with a first of said inlet passages;

said spool means has a second cross-sectional area smaller than said first cross-sectional area;

a second of said inlet passages in said body providing fluid communication to said second cross-sectional area and said first actuator outlet from said inlet, whereupon application of fluid pressure to said inlet and through said first and second inlet passages results in opposing forces acting on said spool, producing a resultant force which moves said spool means from a first to a second position;

a first vent passage extending from said spool means to the outer surface of said body;

said spool means selectively permitting fluid communication between said second inlet passage and said first vent passage in said first position and blocking fluid communication between said second inlet passage and said first vent passage when said spool means in said second position;

said fluid pressure building up at said first actuator outlet as said spool means is driven from said first to said second positions.

10. The apparatus of claim 9, wherein:

said spool means in formed having a plurality of segments, the lowermost segment of said spool means in formed having said first and second cross-sectional areas, said first vent passage extending to said lowermost spool means;

the uppermost segment of said spool means is in fluid communication with said inlet through a third inlet passage and is capable of movement selectively in tandem and independently of said lowermost segment of said spool means;

said second actuator outlet in fluid communication with said uppermost spool means through an outlet passage;

said uppermost spool means movable from a first position where said inlet is isolated from said outlet passage and a second position where said inlet is in flow communication with said outlet passage.

11. The apparatus of claim 10, further comprising:

a second vent passage extending from the outer surface of said body to said uppermost spool means;

said uppermost spool means allowing flow communication from said second actuator outlet, through said outlet passage, to said second vent passage when said uppermost spool means is in said first position and isolating said second actuator outlet and said outlet passage from said second vent passage when said uppermost spool means is in said second position.

12. The apparatus of claim 11, further comprising:

biasing means acting on said spool means to bias said uppermost and lowermost spool means into their respective said first positions in the absence of fluid pressure in said inlet.

13. The apparatus of claim 12, wherein:

said biasing means applies a biasing force to said lower surface of said first cross-sectional area;

whereupon application of fluid pressure through said inlet, the pressure is also applied to said first and second inlet passages, which results in a force applied to said upper surface of said first cross-sectional area, which overcomes said biasing means and the force applied by fluid pressure to said second cross-sectional area, resulting in movement of said lowermost spool means from said first to said second position, independently of said uppermost spool means.

14. The apparatus of claim 13, further comprising:

one-way flow means in said second inlet passage permitting fluid flow only in a direction from said inlet toward said first actuator outlet and said lowermost spool means;

whereupon decrease of fluid pressure from a first pressure to below a trigger point and with said uppermost spool means in said second position, said one-way flow means retains the first pressure against said second cross-sectional area as the fluid pressure on said first cross-sectional area declines to the trigger pressure, whereupon the combined forces of said biasing means and the first pressure acting on said second cross-sectional area overcome the opposing force of trigger pressure applied to said first cross-sectional area, resulting in movement of both said uppermost and lowermost spool means in tandem from their second to their first positions.

15. The apparatus of claim 14, wherein:

said upper and lower spool means are configured when moving in tandem from their respective said second to first positions upon reduction of fluid pressure at said inlet to below a trigger point, to first isolate said second actuator outlet and said outlet passage from said inlet, then to permit fluid communication between said second actuator outlet and said outlet passage to said second vent passage, followed by permitting fluid communication between said first actuator outlet to said first vent passage.

16. The apparatus of claim 15, wherein:

said uppermost and lowermost spool means simultaneously attain a position between their respective first and second positions where said inlet is isolated from said outlet passage, said outlet passage is isolated from said second vent passage, and said second inlet passage is isolated from said first vent passage.

17. The apparatus of claim 15, wherein:

said uppermost spool means extends in part beyond said body, said extended portion allowing selective movement of said uppermost spool means between said first and second positions;

whereupon before initial application of fluid pressure to said inlet, said biasing means retains said uppermost spool means in said first position, and subsequent application of fluid pressure to said inlet results in said fluid pressure being first applied at said first actuator outlet as said lowermost spool means moves independently to its said second position, whereupon application of force to said extending part of said uppermost spool means results in a subsequent application of said fluid pressure from said inlet at said second actuator outlet.

18. The apparatus of claim 17, wherein:

application of a biasing force to said extending portion of said uppermost spool means, urging it from said second to said first position while fluid pressure is applied to said inlet, results in the continued application of fluid pressure at said first actuator outlet, while pressure at said second actuator outlet is relieved by said uppermost spool means, allowing flow communication between said outlet passage and said second vent passage.

19. The valve of claim 18, further comprising:

flow restriction means in said first inlet passage for controlling rate of movement of said lowermost spool between its first and second positions; and relief means to prevent overpressure in said body.

20. The apparatus of claim 19, wherein:

said relief means is a relief valve having an inlet in constant flow communication with said second inlet passage and an outlet in flow communication with said first vent passage;

said body and said lowermost spool means defining a variable-volume sealed chamber in which said biasing means is disposed, said chamber having its smallest volume when said lowermost spool means is in said second position;

said chamber being gas filled which, when compressed by movement of said lowermost spool to its said second position, exerts a force in the same direction as said biasing means on said lowermost spool means.

21. The apparatus of claim 20, further comprising:

a first and second seal circumscribing said lowermost spool means and disposed respectively on each side of said first vent passage;

a third and fourth seal circumscribing said uppermost spool means and respectively mounted on each side of said second vent passage;

a fifth and sixth seal circumscribing said uppermost spool means and respectively mounted on each side of said third inlet passage;

said fourth and fifth seals also disposed respectively on each side of said first outlet passage;

said lowermost spool having a first spline thereon;

said uppermost spool having a second and third spline thereon, said splines allowing flow communication when straddling one of said seals and blocking fluid communication when in between two of said seals;

whereupon initial application of fluid pressure at said inlet moves said first spline from straddling said first seal to a position out from between said first and second seals;

said second spline straddles said fourth seal and said third spline is between said fifth and sixth seals when said uppermost spool means is in said first position;

said second spline is between said third and fourth seals and said third spline straddles said fifth seal when said uppermost spool means is in said second position.

22. The apparatus of claim 21, wherein said first, second, and third splines are disposed in a manner that upon reduction in fluid pressure at said inlet below a trigger point and with said uppermost spool initially in said second position, tandem movement of said uppermost and lowermost spool means results in said third spline first moving from a position where it straddles said fifth seal to a position between said fifth and sixth seals, then said second spline moving from a position where it is between said third and fourth seals to straddling said fourth seal, then said first spline moving from position where it is outside the span between said first and second seals to a position where it straddles said first seal.

23. The apparatus of claim 22, further comprising:

a seventh seal circumscribing said lowermost spool means between said upper and lower surfaces of said first cross-sectional area, sealing at least in part said chamber wherein said biasing means are disposed; and an eighth seal circumscribing said lowermost spool 10, means and disposed between said third and seventh seals;

said body formed having a second cavity partly defined by said upper surface of said first cross-sectional area, and said second cavity is sealed by said seventh and eighth seals and subject to volumetric changes upon movement of said lowermost spool means between said first and second positions;

said first inlet passage in flow communication with said second cavity.

24. An apparatus for directing fluid pressure from a primary source to at least two actuators, comprising:

a body;

at least one inlet into said body for admitting primary source pressure;

at least one first actuator outlet in said body;

at least one second actuator outlet in said body;

spool means selectively movable in said body manually and by fluid pressure from the primary source for selective sequential alignment of the pressure at said inlet to said first and then second actuator outlets as said spool means moves in a first direction, and for selective sequential venting of the pressure at said first and second actuator outlets from said body and isolation of said inlet as said spool means moves in a second direction, opposite said first direction, upon loss of fluid pressure at said inlet;

said spool means selectively manually operable in said second direction to vent at least one of said outlets while isolating it from said inlet;

said body is formed having a plurality of inlet passages providing fluid communication from said inlet to said spool means;

said spool means has a first cross-sectional area having an upper and a lower surface, said upper surface of said first cross-sectional area being in flow communication with a first of said inlet passages;

said spool means has a second cross-sectional area smaller than said first cross-sectional area;

a second of said inlet passages in said body providing fluid communication to said second cross-sectional area and said first actuator outlet from said inlet, whereupon application of fluid pressure to said inlet and through said first and second inlet passage results in opposing forces acting in said spool, producing a resultant force which moves said spool means from a first to a second position.

* * * * *